United States Patent [19]

Tuttle

[11] Patent Number: 4,690,090

[45] Date of Patent: Sep. 1, 1987

[54] CLEAT AND DEVICE THEREFOR

[76] Inventor: William E. Tuttle, 843 SE. St. Lucie Blvd., Stuart, Fla. 33494

[21] Appl. No.: 923,916

[22] Filed: Oct. 28, 1986

[51] Int. Cl.[4] ..... B63B 21/04

[52] U.S. Cl. ..... 114/218; 24/130; 24/115 R

[58] Field of Search ..... 114/218, 230, 221 R; 24/115 K, 115 R, 130; 248/499, 303; D8/382, 356

[56] References Cited

U.S. PATENT DOCUMENTS

| | | | |
|---|---|---|---|
| D. 35,031 | 9/1901 | Schmidt | D8/356 |
| D. 140,381 | 2/1945 | Anderson | D8/356 |
| D. 250,571 | 12/1978 | Winslow | D8/356 |

*Primary Examiner*—Joseph F. Peters, Jr.
*Assistant Examiner*—Edwin L. Swinehart
*Attorney, Agent, or Firm*—Victor F. Volk

[57] ABSTRACT

An improved cleat comprises a wire member that combines with the cleat body to form a plurality of line-snagging wedge-shaped openings.

9 Claims, 5 Drawing Figures

CLEAT AND DEVICE THEREFOR

BACKGROUND OF THE INVENTION

Conventional boat cleats having a base that is secured to a deck or rail and outwardly tapered portions that extend from opposite ends of a top of the base have, for very many years, proven eminently satisfactory for securing lines that are usually required to bear very high tensile load. But even experienced sailors are often unable to fasten a line securely to such cleats using only one hand or to release a line in a hurry. Particularly, on docking, one man making fast the bow line must do so very rapidly to catch another line astern before the boat swings out.

For these reasons continuing attempts have been made to devise an improved cleat to which a line might be more quickly and easily fastened and released.

In U.S. Pat. No. 533,760 to Vachon U-plates are swingably bolted to a cleat for wedging in a rope. This device would clearly require two hands, one to manipulate the rope and one the U-plate.

U.S. Pat. No. 1,493,490 to Holzapfel describes a rope holder wherein an anchor rope passes through an eye into a spring-actuated wedge. It is a feature of cleats that the line end does not have to be available to make the line secure. This feature is absent from the Holzapfel device which also provides very little of the "capstan effect" provided by cleats that is needed for high tensile loads.

U.S. Pat. No. 3,126,859 to Bigelow describes two parallel spring-mounted plates that also require two hands for connecting to a rope or line and also require a spring assembly below deck.

My invention has the advantage that it greatly increases the high capstan effect of standard cleats to sustain very heavy loads.

It has the further advantage that a line can be tied or released to it quickly, using only one hand.

An important further advantage resides in the fact that the benefits of my invention can be simply achieved by adding elements to existing cleats.

SUMMARY OF THE INVENTION

I have invented cleat means comprising a base, outwardly tapered portions extending from opposite ends of the top of this base, and a substantially level upper surface comprising these tapered portions. Two open loops of wire extend downwardly and outwardly at acute angles from a position between the tapered portions to form wedge shaped openings for snagging a line, and a length of wire projects upwardly at an acute angle from the upper surface, combining with the surface to form another wedge-shaped opening for further snagging the line. Advantageously my loops and projecting length of wire will comprise a single continuous member that is clamped to the base of the cleat means by means such as a hose clamp.

My device for improving the line-snagging properties of a conventional deck cleat comprises a continuous length of wire that is permanently bent into a first and second oppositely extending, downwardly sloping open loop which each comprise an inner width substantially equal to an outer width of the cleat. The wire of the first loop comprises a portion that extends upwardly and, when the device is clamped to a cleat, will combine with the top surface of the cleat to form a wedge-shaped opening for snagging a line. The two loops will then also combine with tapered portions of the cleat to form wedge-shaped line-snagging openings.

DETAILED DESCRIPTION OF PREFERRED EMBODIMENT

Figure 2:
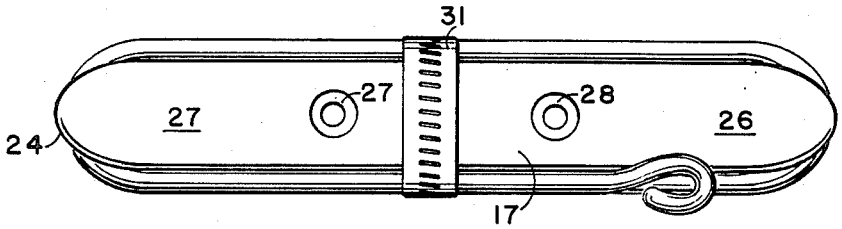
FIG. 2 shows a plan of the cleat means of FIG. 1.
Figure 3:
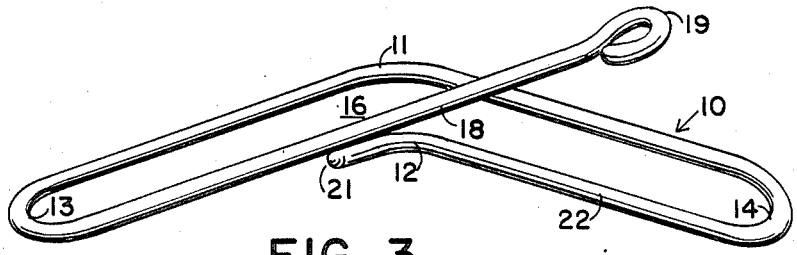
FIG. 3 shows a pictorial view of a wire device for improving a cleat to my invention.

Referring first to FIG. 3 my device 10 is comprised of wire bent downwardly at the points 11 and 12 in loops 13, 14 that are open in the area 16 between the bends to a width about equal to the width of a cleat 17 (FIG. 2). An arm 18 of the loop 13 extends upwardly and terminates in a tight circle 19 that avoids a sharp end. An extension 21 of an arm 22 of the loop 14, after bending at 12 lies snugly against the underpart of the arm 18 and may be welded or otherwise bonded to that arm.

Figure 1:
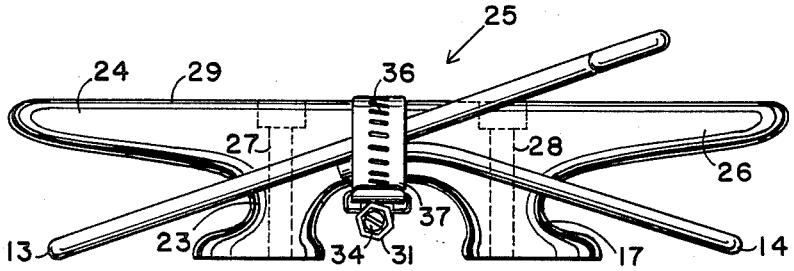
FIG. 1 shows an elevation of cleat means of my invention.
Figure 5:
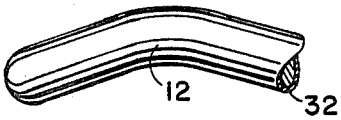
FIG. 5 shows the a length of the wire of FIG. 4 with a polymeric coating.

When the device 10 is fitted to the cleat 17 (FIGS. 1 and 2) it forms an improved cleat means 25. The conventional cleat 17 comprises a base 23 with outwardly tapered portions 24 and 26, bolt holes 27, 28 and a substantially level upper surface 29. The wire device 10 is clamped to the cleat 17 by means of a conventional hose clamp 31. But other means of locking the device 10 to the cleat 17, such as welding, where the cleat is steel, or brazing, etc. may be practiced within the scope of my invention. Where the cleat 17 is nylon or other synthetic material the hose clamp is particularly applicable, and I prefer the known type of clamp which comprises a worm with a slotted head 34 that engages slots 36 or an encircling band 37. This type of clamp can be tightened to high tension and is readily available in stainless steel. But other hose clamps may also be used within the scope of my invention. The wire forming the device 10 is preferably a spring tempered stainless steel but it may be bronze or other metal within the scope of my invention or synthetic material of great strength such as graphite filled plastic. In FIG. 5 I have shown a length of the wire of my device 10 with an extruded covering 32 of weather resistant synthetic polymer such as polyvinyl chloride. This covering not only improves weathering and may obviate the need for stainless steel, but offers a surface with more frictional resistance and better snagging properties.

Figure 4:
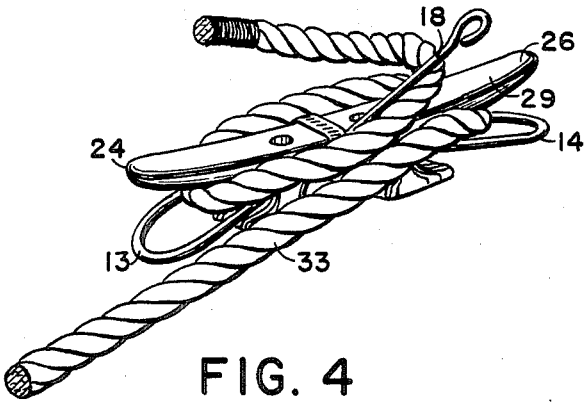
FIG. 4 shows a pictorial view of a line attached to my cleat means.

In FIG. 4 a line or rope 33 has been tied to my cleat means 25. The line 33 has been passed through the wedge-shaped opening between the loop 14 and the tapered portion 26, then back through the wedge-shaped opening formed between the loop 13 and the tapered portion 24, and finally up between the arm 18 and the surface 29. In doing so the line 33 passes through five points of snagging which, combined with the normal capstan effect of bending around turns, affords great holding power. At the same time a sailor is able to make this line fast very rapidly using only one hand, and to release it with one hand as well. For instance, if the line 33 is a bow anchor rope, a lone helmsman can reach down with one hand and snag the anchor without relinquishing the wheel.

The foregoing description has been exemplary rather than definitive of my invention for which I desire an award of Letters Patent as defined in the appended claims.

I claim:

1. Cleat means comprising:

(A) a base section, (B) outwardly tapered portions extending from opposite ends of a top of said base section, (C) a substantially level upper surface comprising said portions, (D) two open loops of wire each extending outwardly and downwardly from a position between said tapered portions thereby combining with said portions to form wedge-shaped openings for snagging a line, and (E) a length of wire projecting upwardly at an acute angle to said upper surface and combining therewith to form a wedge-shaped opening for snagging a line.

2. The cleat means of claim 1 wherein said loops and said length of wire comprise a single continuous member.

3. The cleat means of claim 1 comprising means clamping said loops and said length of wire to said base section.

4. The cleat means of claim 3 wherein said clamping means comprises a hose clamp.

5. The cleat means of claim 1 comprising a synthetic polymeric coating around the wire of said loops and said length of wire.

6. A device for improving the line snagging properties of a conventional deck cleat, comprising a continuous length of wire, said wire being bent to comprise a first and a second oppositely extending, downwardly sloping open loops, said loops comprising an inner width substantially equal to an outer width of said cleath, the wire of said first loop comprising a portion extending upwardly, thereby, upon said device being clamped to said cleat, combining with a top surface of said cleat to form a wedge-shaped opening for snagging a line, and said loops combining with tapered portions of said cleat to form wedge-shaped openings for snagging a line.

7. The device of claim 6 comprising means for clamping to said cleat.

8. The device of claim 7 wherein said clamping means comprises a hose clamp.

9. The device of claim 6 comprising a synthetic polymeric coating around said length of wire.

* * * * *